US009905146B2

(12) United States Patent
Wang et al.

(10) Patent No.: US 9,905,146 B2
(45) Date of Patent: Feb. 27, 2018

(54) RGBW TFT LCD HAVING REDUCED HORIZONTAL CROSSTALK

(71) Applicant: Century Technology (Shenzhen) Corporation Limited, Shenzhen (CN)

(72) Inventors: Ming-Tsung Wang, New Taipei (TW); Chih-Chung Liu, New Taipei (TW); Jian-Xin Liu, Shenzhen (CN); Li-Fang Wang, Shenzhen (CN)

(73) Assignee: Century Technology (Shenzhen) Corporation Limited, Shenzhen (CN)

( * ) Notice: Subject to any disclaimer, the term of this patent is extended or adjusted under 35 U.S.C. 154(b) by 219 days.

(21) Appl. No.: 14/848,001

(22) Filed: Sep. 8, 2015

(65) Prior Publication Data

US 2017/0061844 A1 Mar. 2, 2017

(30) Foreign Application Priority Data

Aug. 31, 2015 (CN) ..... 2015 1 0544424

(51) Int. Cl.
*G09G 3/36* (2006.01)
*G09G 3/20* (2006.01)

(52) U.S. Cl.
CPC ..... *G09G 3/2003* (2013.01); *G09G 3/3614* (2013.01); *G09G 2300/0452* (2013.01)

(58) Field of Classification Search
CPC .. G09G 3/3665; G09G 3/3607; G09G 3/3614; G09G 3/3648; G09G 3/2003; G09G 2310/0218; G09G 2320/0247; G09G 2320/0209; G09G 2300/0452
See application file for complete search history.

(56) References Cited

U.S. PATENT DOCUMENTS 6,552,706 B1 * 4/2003 Ikeda ..... G09G 3/3607 345/100
2003/0090450 A1 * 5/2003 Inada ..... G09G 3/3614 345/87
2014/0285542 A1 * 9/2014 Izumi ..... G09G 3/2003 345/694
2015/0379947 A1 * 12/2015 Sang ..... G09G 3/3614 349/37
2016/0299391 A1 10/2016 Liu et al.

FOREIGN PATENT DOCUMENTS

CN 104820325 A 8/2015

* cited by examiner

*Primary Examiner* — Lun-Yi Lao
*Assistant Examiner* — Jarurat Suteerawongsa
(74) *Attorney, Agent, or Firm* — ScienBiziP, P.C.

(57) ABSTRACT

A TFT array substrate for a TFT LCD includes a plurality of pixels each consisting of a red sub-pixel, a green sub-pixel, a blue sub-pixel and a white sub-pixel arranged in a 2×2 matrix. Two data lines are located between each two neighboring columns of the sub-pixels. A scan line is located between two neighboring rows of the sub-pixels. The sub-pixels are driven by column inversion. The scan lines in electrical connections with different rows of the pixels are turned on successively along a vertical direction. Two neighboring same colored sub-pixels in a same row of the sub-pixels have opposite polarities and two neighboring same colored sub-pixel in a same column of the sub-pixels respectively have the same polarity when the TFT LCD is operated to output a screen having a color the same as the color of the two neighboring same colored sub-pixels.

4 Claims, 6 Drawing Sheets

RGBW TFT LCD HAVING REDUCED HORIZONTAL CROSSTALK

CROSS-REFERENCE TO RELATED APPLICATIONS

This application claims priority to Chinese Patent Application No. 201510544424.9 filed on Aug. 31, 2015, the contents of which are incorporated by reference herein.

FIELD

The subject matter herein generally relates to a TFT LCD (thin film transistor liquid crystal display), and particularly to a TFT LCD having an RGBW (red, green, blue, white) TFT array substrate with a reduced horizontal crosstalk.

BACKGROUND

TFT LCDs have become the most popular flat displays since they have advantages of compactness, low heat generation, long life and visual comfort. In general a TFT LCD includes a backlight module, a first polarizer, a TFT array substrate, a liquid crystal layer, a color filter and a second polarizer. The TFT array substrate forms a plurality of pixels thereon. The liquid crystal layer contains a plurality liquid crystals therein. Originally, each pixel includes three sub-pixels, i.e., a red sub-pixel, a green sub-pixel, and a blue sub-pixel.

An RGBW ITT LCD is configured to have each pixel include a red sub-pixel, a green sub-pixel, a blue sub-pixel, and a white sub-pixel. A transparent area corresponding to the white sub-pixel is defined in the color filter, whereby a light transmittance of the color filter is improved, and the power consumption required by the backlight module can be reduced.

BRIEF DESCRIPTION OF THE DRAWINGS

Many aspects of the disclosure can be better understood with reference to the following drawings. The components in the drawings are not necessarily drawn to scale, the emphasis instead being: placed upon clearly illustrating the principles of the disclosure. Moreover, in the drawings, like reference numerals designate corresponding parts throughout the several views.

DETAILED DESCRIPTION

Figure 1:
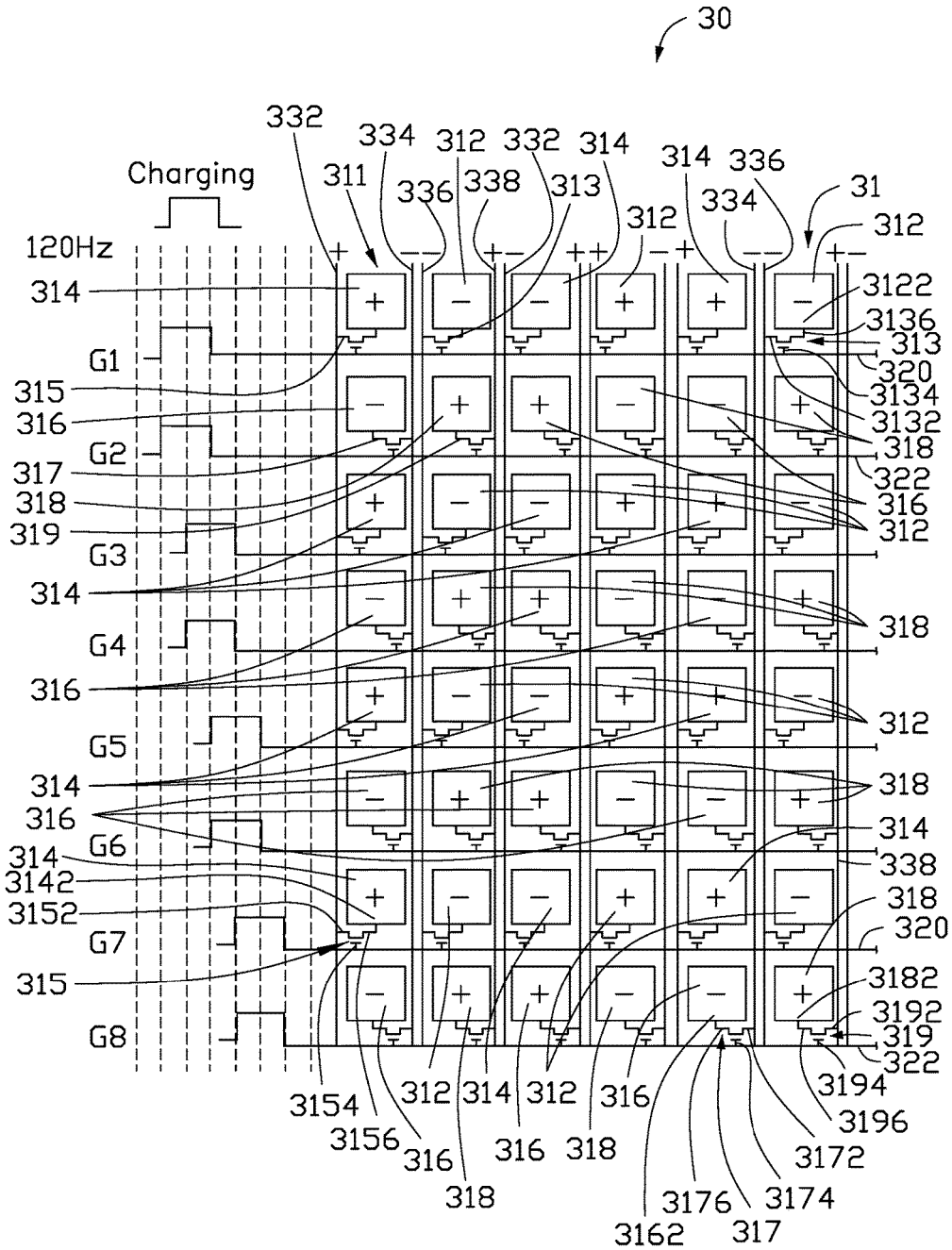
FIG. 1 is a diagram of a TFT array substrate of an RGBW TFT LCD in accordance with a first embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

Referring to FIG. 1, a circuit 31 of a TFT array substrate 30 of an RGBW TFT LCD in accordance with a first embodiment of the present disclosure is shown. The TFT substrate 30 of the RGBW TFT LCD can be used in a screen of a mobile phone for example a smart phone, a monitor of a computer, a screen of a laptop, a screen of a television set, or a screen of a tablet computer. The circuit 31 is arranged in a manner that it is driven by column inversion and includes a plurality of pixels 311 arranged in a matrix. Although FIG. 1 shows that the pixels are arranged in three columns and four rows, it can be understood that the actual matrix number of the pixels 311 is far larger than 3×4, which can be, for example, 4096×2160 for a display of a 4K2K television, a kind of high definition (HD) television. Each pixel 311 consists of a red sub-pixel 312, a green sub-pixel 314, a blue sub-pixel 316 and a white sub-pixel 318. The four sub-pixels 312, 314, 316, 318 are arranged in a substantially square matrix (i.e., 2×2 matrix) with the red and green sub-pixels 312, 314 arranged in a same row and the blue and white sub-pixels 316, 318 arranged in a neighboring same row, while the red and white sub-pixels 312, 318 arranged in a same column and the green and blue sub-pixels 314, 316 arranged in a neighboring same column. In their respective same row, the red and green sub-pixels 312, 314 are alternated, and the blue and white sub-pixels 316, 318 are alternated. In their respective same column, the red and white sub-pixels 312, 318 are alternated, and the green and blue sub-pixels 314, 316 are alternated.

Along the column direction (horizontal direction), two data lines 334, 336 are located between every two adjacent columns of the sub-pixels 312, 314, 316, 318 of a respective column of the pixels 311 and two other data lines 338, 332 are located between every two adjacent columns of the pixels 311. A first scan line 320 is located between every two adjacent rows of the sub-pixels 312, 314, 316, 318 of a respective row of the pixel 311. A second scan line 322 is located between every two adjacent rows of the pixels 311. The first and second scan lines 320, 322 are orthogonal to and intersecting with the data lines 332, 334, 336, 338. The data lines 332, 334, 336, 338 and the scan lines 320, 322 are electrically coupled to the sub-pixels 312, 314, 316, 318. In the frame of FIG. 1, the data lines 332, 334, 336, 338 are applied with voltages having polarities of +, −, −, +, then −, +, +, −, and then a repeated pattern of the aforesaid polarities along a left to right direction of FIG. 1.

The red sub-pixel 312 of a first pixel 311, for example, the pixel at a leftmost and topmost corner of the circuit 31 is electrically connected with the first scan line 320 immediately therebelow and the data line 336 adjacent thereto by a thin film transistor 313. The thin film transistor 313 has a source electrode 3132 (for clarity labeled in another thin film transistor 313) in electrical coupling with the data line 336, a gate electrode 3134 in electrical coupling with the first scan line 320 and a drain electrode 3136 in electrical coupling with a pixel electrode 3122 of the red sub-pixel 312. The red sub-pixel 312 of a second pixel neighboring the first pixel and in the same row therewith is electrically connected with the first scan line 320 immediately therebelow and the data line 336 adjacent thereto by a corresponding thin film transistor. The red sub-pixels of the other pixels in the same row sequentially repeat the electrical connections of the red sub-pixels of the first and second pixels with the first scan line 320 and the data lines 336. The red sub-pixel 312 of a third pixel neighboring the first pixel and in the same column therewith is electrically connected with the first scan line 320 immediately therebelow and the data line 336 adjacent thereto by a corresponding thin film transistor. The red sub-pixels of the other pixels in the same column sequentially repeat the electrical connections of the red sub-pixels of the first and third pixels with the first scan lines 320 and the data line 336.

The green sub-pixel 314 of the first pixel 311 is electrically connected with the first scan line 320 immediately therebelow and the data line 332 adjacent thereto by a thin film transistor 315. The thin film transistor 315 has a source electrode 3152 (for clarity labeled in another thin film transistor 315) in electrical coupling with the data line 332, a gate electrode 3154 in electrical coupling with the first scan line 320 and a drain electrode 3156 in electrical coupling with a pixel electrode 3142 of the green sub-pixel 314. The green sub-pixel 314 of the second pixel neighboring the first pixel and in the same row therewith is electrically connected with the first scan line 320 immediately therebelow and the data line 332 adjacent thereto by a corresponding thin film transistor. The green sub-pixels of the other pixels in the same row sequentially repeat the electrical connections of the green sub-pixels of the first and second pixels with the first scan line 320 and the data lines 332. The green sub-pixel 314 of the third pixel neighboring the first pixel and in the same column therewith is electrically connected with the first scan line 320 immediately therebelow and the data line 332 adjacent thereto by a corresponding thin film transistor. The green sub-pixels of the other pixels in the same column sequentially repeat the electrical connections of the green sub-pixels of the first and third pixels with the first scan lines 320 and the data line 332.

The blue sub-pixel 316 of the first pixel 311 is electrically connected with the second scan line 322 immediately therebelow and the data line 334 adjacent thereto by a thin film transistor 317. The thin film transistor 317 has a source electrode 3172 (for clarity labeled in another thin film transistor 317) in electrical coupling with the data line 334, a gate electrode 3174 in electrical coupling with the second scan line 322 and a drain electrode 3176 in electrical coupling with a pixel electrode 3162 of the blue sub-pixel 316. The blue sub-pixel 316 of the second pixel neighboring the first pixel and in the same row therewith is electrically connected with the second scan line 322 immediately therebelow and the data line 334 adjacent thereto by a corresponding thin film transistor. The blue sub-pixels of the other pixels in the same row sequentially repeat the electrical connections of the blue sub-pixels of the first and second pixels with the second scan line 322 and the data lines 334. The blue sub-pixel 316 of the third pixel neighboring the first pixel and in the same column therewith is electrically connected with the second scan line 322 immediately therebelow and the data line 334 adjacent thereto by a corresponding thin film transistor. The blue sub-pixels of the other pixels in the same column sequentially repeat the electrical connections of the blue sub-pixels of the first and third pixels with the second scan lines 322 and the data line 334.

The white sub-pixel 318 of the first pixel 311 is electrically connected with the second scan line 322 immediately therebelow and the data line 338 adjacent thereto by a thin film transistor 319. The thin film transistor 319 has a source electrode 3192 (for clarity labeled in another thin film transistor 319) in electrical coupling with the data line 338, a gate electrode 3194 in electrical coupling with the second scan line 322 and a drain electrode 3196 in electrical coupling with a pixel electrode 3182 of the white sub-pixel 318. The white sub-pixel 318 of the second pixel neighboring the first pixel and in the same row therewith is electrically connected with the second scan line 322 immediately therebelow and the data line 338 adjacent thereto by a corresponding thin film transistor. The white sub-pixels of the other pixels in the same row sequentially repeat the electrical connections of the white sub-pixels of the first and second pixels with the second scan line 322 and the data lines 338. The white sub-pixel of the third pixel neighboring the first pixel and in the same column therewith is electrically connected with the second scan line 322 immediately therebelow and the data line 338 adjacent thereto by a corresponding thin film transistor. The white sub-pixels of the other pixels in the same column sequentially repeat the electrical connections of the white sub-pixels of the first and third pixels with the second scan lines 322 and the data line 338. Since in this embodiment, the sub-pixels are driven by column inversion, along each of the data lines 332, 334, 336, 338, the sub-pixels in electrical connection therewith have the same polarity.

Figure 2:
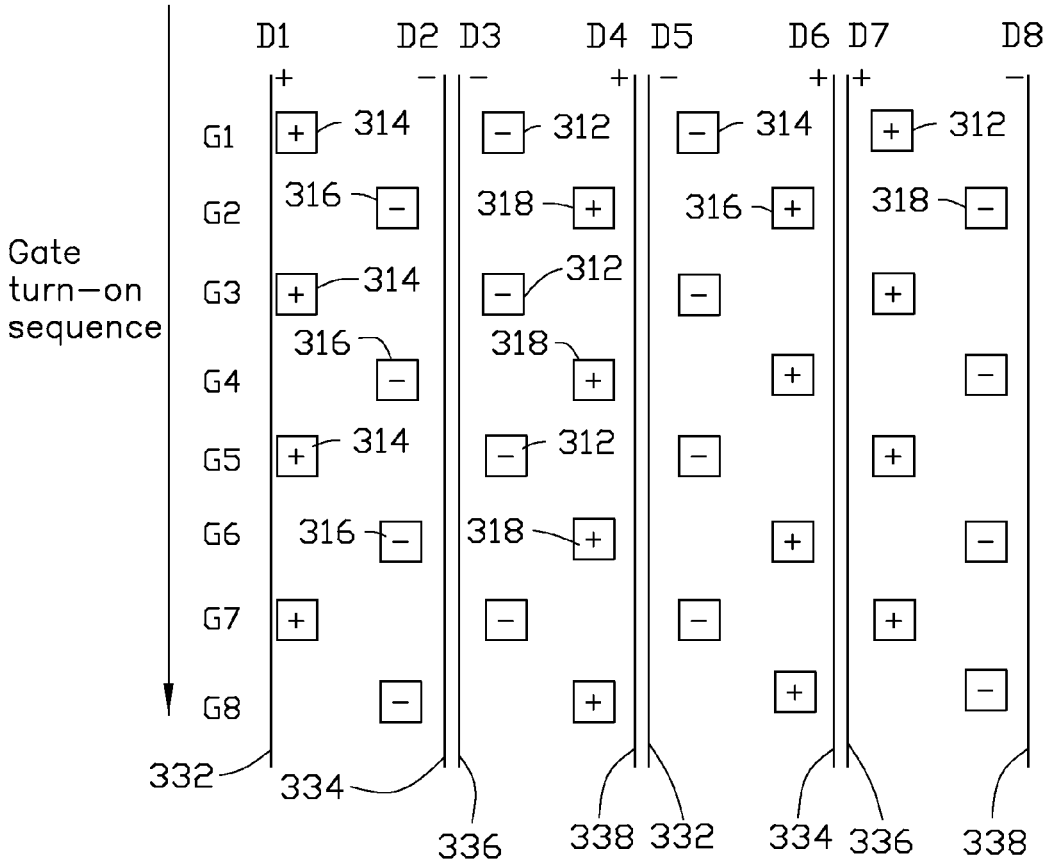
FIG. 2 is a diagram showing a control sequence of scan lines of the TFT array substrate of FIG. 1.

In operation, in the frame shown in FIG. 2, the data lines 332, 334, 336, 338 for the sub-pixels in a pixel are supplied with voltages which have polarities opposite to the polarities of the voltages supplied to the sub-pixels of an immediately neighboring pixel in the same row, i.e., positive for the data lines 332, 338 and negative for the data lines 334, 336 for the first pixel and negative for the data lines 332, 338 and positive for the data lines 334, 336 for the second pixel. Thus, the red (green, blue, white) sub-pixel 312 (314, 316, 318) and a neighboring red (green, blue, white) sub-pixel in the same row have opposite polarities. The first and second scan lines 320, 322 are successively turned on along a top to bottom direction, wherein each time two respective first and second scan lines 320, 322 are turned on. In other words, the gates G1, G2 of the thin film transistors in connection with the upmost first and second scan lines 320, 322 are firstly turned on; then the gates G3, G4 are turned on, and so on. Accordingly when the RGBW TFT LCD having the TFT array substrate 30 is required to show a single color of one of the red, green, blue and white colors, the pixels 311 in two neighboring columns of a same row have opposite polarities, i.e., one being positive and the other being negative. By such arrangement, the coupling effects caused by capacitors (Cscs) of each two neighboring columns of the pixels 311 on the waveform of a common electrode (Com) can offset from each other to obviate the horizontal crosstalk, wherein the capacitor (Csc) is a capacitor interconnecting a corresponding data line and the common electrode (Com) for supplying a bias across a liquid crystal layer.

Figure 3:
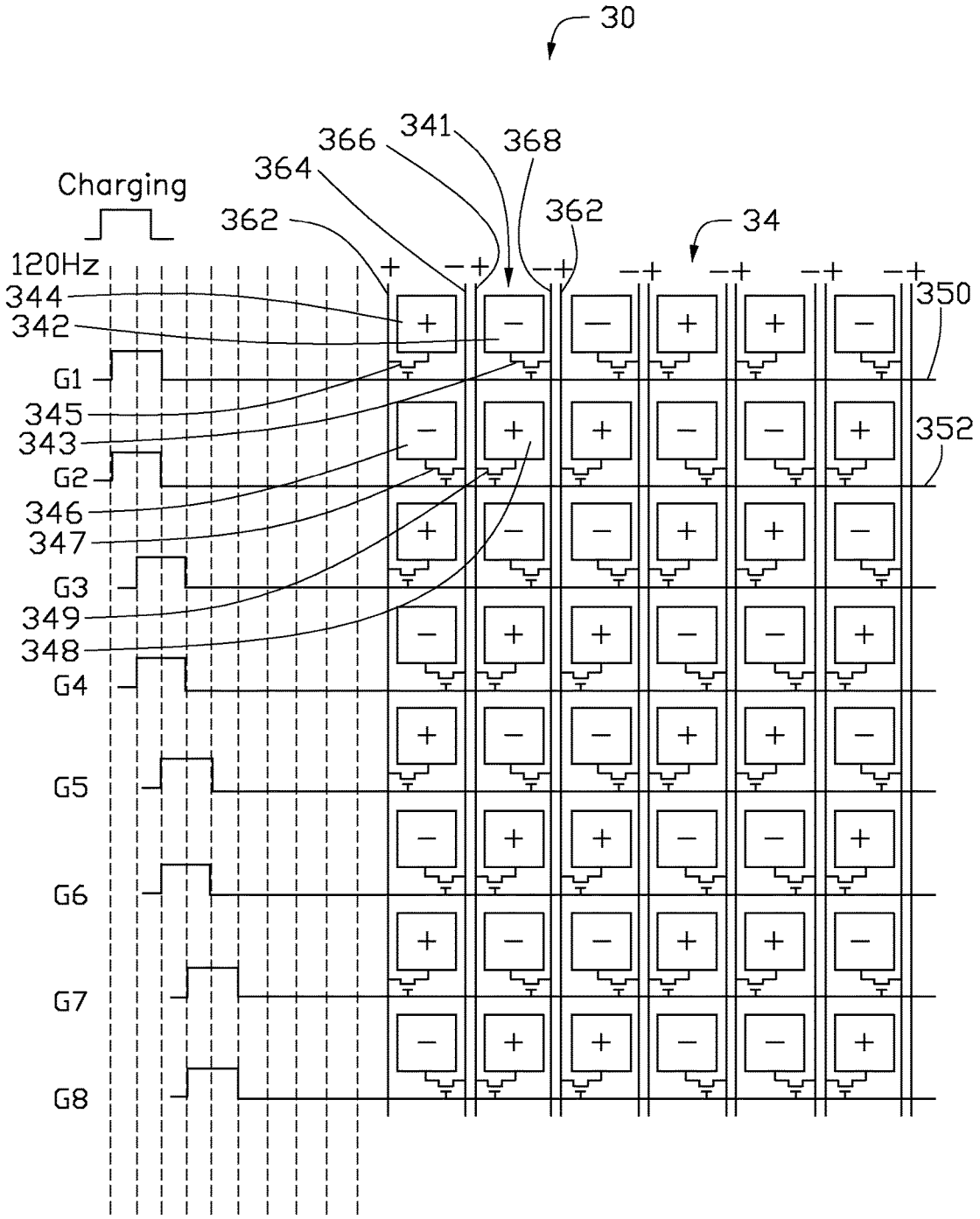
FIG. 3 is a diagram of a TFT array substrate of an RGBW TFT LCD in accordance with a second embodiment of the present disclosure.

Referring to FIG. 3, a circuit 34 of the TFT array substrate 30 of the RGBW TFT LCD in accordance with a second embodiment of the present disclosure is shown. The circuit 34 is arranged in a manner that it is driven by column inversion and includes a plurality of pixels 341 arranged in a matrix. Although FIG. 3 shows that the pixels 341 are arranged in three columns and four rows, it can be understood that the actual matrix number of the pixels 341 is far larger than 3×4, which can be, for example, 4096×2160 for a display of a 4K2K television which is a kind of high definition (HD) television. Each pixel 341 consists of a red sub-pixel 342, a green sub-pixel 344, a blue sub-pixel 346 and a white sub-pixel 348. The four sub-pixels 342, 344, 346, 348 are arranged in a substantially square matrix (for example, 2×2 matrix) with the red and green sub-pixels 342, 344 arranged in a same row and the blue and white sub-pixels 346, 348 arranged in a neighboring same row, while the red and white sub-pixels 342, 348 arranged in a same column and the green and blue sub-pixels 344, 346 arranged in a neighboring same column. In their respective same row, the red and green sub-pixels 342, 344 are alternated, and the blue and white sub-pixels 346, 348 are alternated. In their respective same column, the red and white sub-pixels 342, 348 are alternated, and the green and blue sub-pixels 344, 346 are alternated.

Along the column direction (horizontal direction), two data lines 364, 366 are located between every two adjacent columns of the sub-pixels 342, 344, 346, 348 of a respective column of the pixels 341 and two other data lines 368, 362 are located between every two adjacent columns of the pixels 341. A first scan line 350 is located between every two adjacent rows of the sub-pixels 342, 344, 346, 348 of a respective row of the pixels 341. A second scan line 352 is located between every two adjacent rows of the pixels 341. The first and second scan lines 350, 352 are orthogonal to and intersecting with the data lines 362, 364, 366, 368. The data lines 362, 364, 366, 368 and the scan lines 350, 352 are electrically coupled to the sub-pixels 342, 344, 346, 348. In the frame of FIG. 3, the data lines 362, 364, 366, 368 are applied with voltages having polarities of +, −, +, −.

The red sub-pixel 342 of a first pixel 341, i.e., the pixel at a leftmost and topmost corner of the circuit 34 is electrically connected with the first scan line 350 immediately therebelow and the data line 368 adjacent thereto by a thin film transistor 343. The thin film transistor 343 has a source electrode in electrical coupling with the data line 368, a gate electrode in electrical coupling with the first scan line 350 and a drain electrode in electrical coupling with a pixel electrode of the red sub-pixel 342. The red sub-pixel 342 of a second pixel neighboring the first pixel and in the same row therewith is electrically connected with the first scan line 350 immediately therebelow and the data line 366 adjacent thereto by a corresponding thin film transistor. The red sub-pixels of the other pixels in the same row sequentially repeat the electrical connections of the red sub-pixels of the first and second pixels with the first scan line 350 and the data lines 368, 366, respectively. The red sub-pixel of a third pixel neighboring the first pixel and in the same column therewith is electrically connected with the first scan line 350 immediately therebelow and the data line 366 adjacent thereto by a corresponding thin film transistor. The red sub-pixels of the other pixels in the same column sequentially repeat the electrical connections of the red sub-pixels of the first and third pixels with the first scan lines 350 and the data line 366.

The green sub-pixel 344 of the first pixel 341 is electrically connected with the first scan line 350 immediately therebelow and the data line 362 adjacent thereto by a thin film transistor 345. The thin film transistor 345 has a source electrode in electrical coupling with the data line 362, a gate electrode in electrical coupling with the first scan line 350 and a drain electrode in electrical coupling with a pixel electrode of the green sub-pixel 344. The green sub-pixel 344 of the second pixel neighboring the first pixel and in the same row therewith is electrically connected with the first scan line 350 immediately therebelow and the data line 364 adjacent thereto by a corresponding thin film transistor. The green sub-pixels of the other pixels in the same row sequentially repeat the electrical connections of the green sub-pixels of the first and second pixels with the first scan line 350 and the data lines 362, 364, respectively. The green sub-pixel of the third pixel neighboring the first pixel and in the same column therewith is electrically connected with the first scan line 350 immediately therebelow and the data line 362 adjacent thereto by a corresponding thin film transistor. The green sub-pixels of the other pixels in the same column sequentially repeat the electrical connections of the green sub-pixels of the first and third pixels with the first scan lines 350 and the data line 362.

The blue sub-pixel 346 of the first pixel 341 is electrically connected with the second scan line 352 immediately therebelow and the data lines 364 adjacent thereto by a thin film transistor 347. The thin film transistor 347 has a source electrode in electrical coupling with the data line 364, a gate electrode in electrical coupling with the second scan line 352 and a drain electrode in electrical coupling with a pixel electrode of the blue sub-pixel 346. The blue sub-pixel of the second pixel neighboring the first pixel and in the same row therewith is electrically connected with the second scan line 352 immediately therebelow and the data line 362 adjacent thereto by a corresponding thin film transistor. The blue sub-pixels of the other pixels in the same row sequentially repeat the electrical connections of the blue sub-pixels of the first and second pixels with the second scan line 352 and the data lines 364, 362, respectively. The blue sub-pixel of the third pixel neighboring the first pixel and in the same column therewith is electrically connected with the second scan line 352 immediately therebelow and the data line 364 adjacent thereto by a corresponding thin film transistor. The blue sub-pixels of the other pixels in the same column sequentially repeat the electrical connections of the blue sub-pixels of the first and third pixels with the second scan lines 352 and the data line 364.

The white sub-pixel 348 of the first pixel 341 is electrically connected with the second scan line 352 immediately therebelow and the data line 366 adjacent thereto by a thin film transistor 349. The thin film transistor 349 has a source electrode in electrical coupling with the data line 366, a gate electrode in electrical coupling with the second scan line 352 and a drain electrode in electrical coupling with a pixel electrode of the white sub-pixel 348. The white sub-pixel of the second pixel neighboring the first pixel and in the same row therewith is electrically connected with the second scan line 352 immediately therebelow and the data line 368 adjacent thereto by a corresponding thin film transistor. The white sub-pixels of the other pixels in the same row sequentially repeat the electrical connections of the white sub-pixels of the first and second pixels with the second scan line 352 and the data lines 366, 368, respectively. The white sub-pixel of the third pixel neighboring the first pixel and in the same column therewith is electrically connected with the second scan line 352 immediately therebelow and the data line 366 adjacent thereto by a corresponding thin film transistor. The white sub-pixels of the other pixels in the same column sequentially repeat the electrical connections of the white sub-pixels of the first and third pixels with the second scan lines 352 and the data line 366. Since in this embodiment, the sub-pixels are driven by column inversion, along each of the data lines 362, 364, 366, 368 the sub-pixels in electrical connection therewith have the same polarity.

Figure 4:
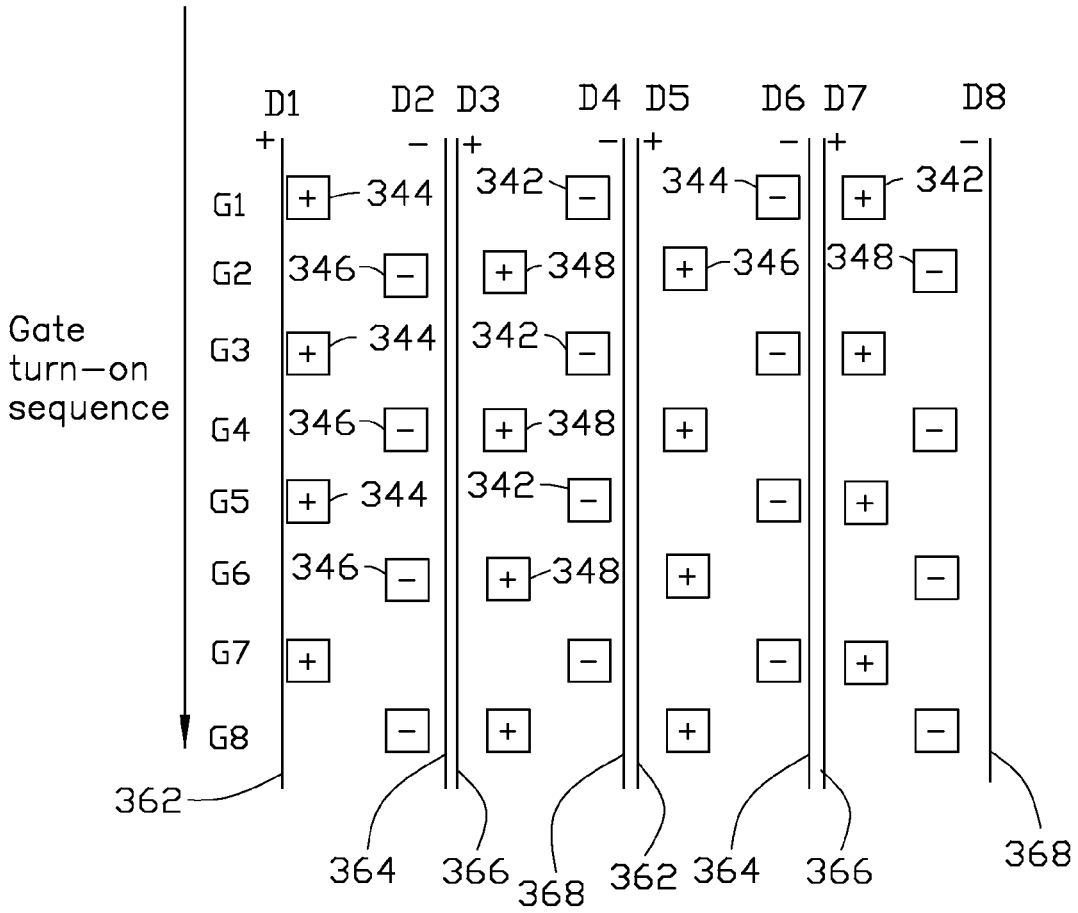
FIG. 4 is a diagram showing: a control sequence of scan lines of the TFT array substrate of FIG. 3.

In operation, in the frame shown in FIG. 4, the data lines 362, 364, 366, 368 are alternately supplied with positive voltage (for data lines 362, 366) and negative voltage (for data lines 364, 368), whereby the red (green, blue, white) sub-pixel 342 (344, 346, 348) and a neighboring red (green, blue, white) sub-pixel in the same row have opposite polarities. The first and second scan lines 350, 352 are successively turned on along a top to bottom direction, wherein each time two respective first and second scan lines 350, 352 are turned on. In other words, the gates G1, G2 of the thin film transistors in connection with the upmost first and second scan lines 350, 352 are firstly turned on; then the gates G3, G4 are turned on, and so on. Accordingly when the RGBW TFT LCD having the TFT substrate 30 is required to show a single color of one of the red, green, blue and white colors, the pixels 341 in two neighboring columns have opposite polarities, i.e., one being positive and the other being negative. By such arrangement, the coupling effects caused by capacitors (Cscs, not shown) of each two neighboring columns of the pixels 341 on the waveform of a common electrode (Com, not shown) can offset from each other to obviate the horizontal crosstalk, wherein the capacitor (Csc) is a capacitor interconnecting a corresponding data line and the common electrode (Com) for supplying a bias across a liquid crystal layer (not shown). The common electrode (Com) and the capacitors (Cscs) are well known by those skilled in the art; detailed descriptions thereof are omitted here.

Figure 5:
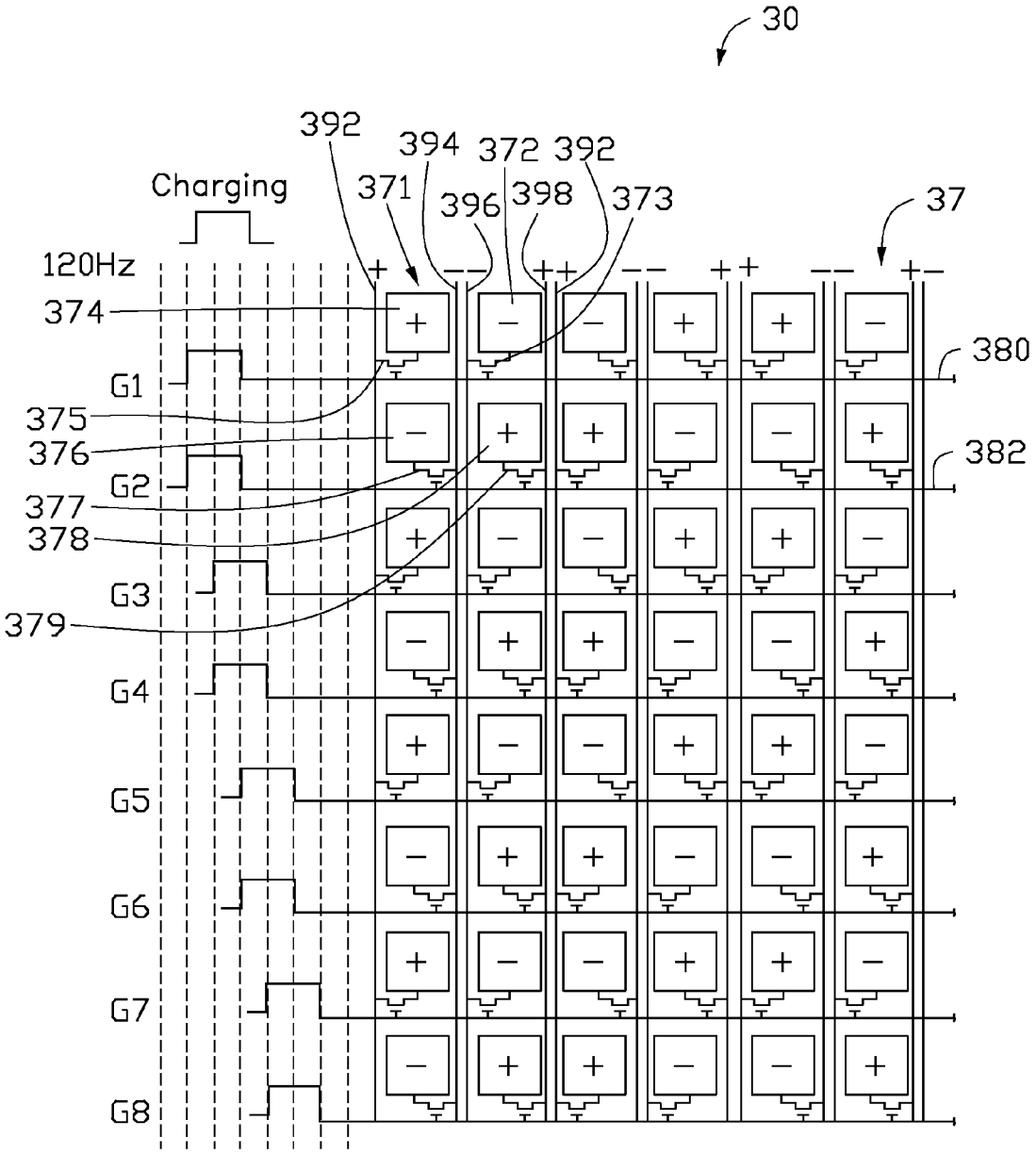
FIG. 5 is a diagram of a TFT array substrate of an RGBW TFT LCD in accordance with a third embodiment of the present disclosure.

Referring to FIG. 5, a circuit 37 of the TFT array substrate 30 of the RGBW TFT LCD in accordance with a third embodiment of the present disclosure is shown. The circuit 37 is arranged in a manner that it is driven by column inversion and includes a plurality of pixels 371 arranged in a matrix. Although FIG. 5 shows that the pixels 371 are arranged in three columns and four rows, it can be understood that the actual matrix number of the pixels 371 is far larger than 3×4, which can be, for example, 4096×2160 for a display of a 4K2K television, a kind of high definition (HD) television. Each pixel 371 consists of a red sub-pixel 372, a green sub-pixel 374, a blue sub-pixel 376 and a white sub-pixel 378. The four sub-pixels 372, 374, 376, 378 are arranged in a substantially square matrix (i.e., 2×2 matrix) with the red and green sub-pixels 372, 374 arranged in a same row and the blue and white sub-pixels 376, 378 arranged in a neighboring same row, while the red and white sub-pixels 372, 378 arranged in a same column and the green and blue sub-pixels 374, 376 arranged in a neighboring same column. In their respective same row, the red and green sub-pixels 372, 374 are alternated, and the blue and white sub-pixels 376, 378 are alternated. In their respective same column, the red and white sub-pixels 372, 378 are alternated, and the green and blue sub-pixels 374, 376 are alternated.

Along the column direction (horizontal direction), two data lines 394, 396 are located between every two adjacent columns of the sub-pixels 372, 374, 376, 378 of a respective column of the pixels 371 and two other data lines 398, 392 are located between every two adjacent columns of the pixels 371. A first scan line 380 is located between every two adjacent rows of the sub-pixels 372, 374, 376, 378 of a respective row of the pixels 371. A second scan line 382 is located between every two adjacent rows of the pixels 371. The first and second scan lines 380, 382 are orthogonal to and intersecting with the data lines 392, 394, 396, 398. The data lines 392, 394, 396, 398 and the scan lines 380, 382 are electrically coupled to the sub-pixels 372, 374, 376, 378. In the frame of FIG. 5, the data lines 392, 394, 396, 398 are applied with voltages having polarities of +, −, −, +.

The red sub-pixel 372 of a first pixel 371, i.e., the pixel at a leftmost and topmost corner of the circuit 37 is electrically connected with the first scan line 380 immediately therebelow and the data line 396 adjacent thereto by a thin film transistor 373. The thin film transistor 373 has a source electrode in electrical coupling with the data line 396, a gate electrode in electrical coupling with the first scan line 380 and a drain electrode in electrical coupling with a pixel electrode of the red sub-pixel 372. The red sub-pixel 372 of a second pixel neighboring the first pixel and in the same row therewith is electrically connected with the first scan line 380 immediately therebelow and the data line 398 adjacent thereto by a corresponding thin film transistor. Then the red sub-pixels of the other pixels in the same row sequentially repeat the electrical connections of the red sub-pixels of the first and second pixels with the first scan line 380 and the data lines 396, 398, respectively. The red sub-pixel of a third pixel neighboring the first pixel and in the same column therewith is electrically connected with the first scan line 380 immediately therebelow and the data line 396 adjacent thereto by a corresponding thin film transistor. Then the red sub-pixels of the other pixels in the same column sequentially repeat the electrical connections of the red sub-pixels of the first and third pixels with the first scan lines 380 and the data line 396.

The green sub-pixel 374 of the first pixel 371 is electrically connected with the first scan line 380 immediately therebelow and the data line 392 adjacent thereto by a thin film transistor 375. The thin film transistor 375 has a source electrode in electrical coupling with the data line 392, a gate electrode in electrical coupling with the first scan line 380 and a drain electrode in electrical coupling with a pixel electrode of the green sub-pixel 374. The green sub-pixel 374 of the second pixel neighboring the first pixel and in the same row therewith is electrically connected with the first scan line 380 immediately therebelow and the data line 394 adjacent thereto by a corresponding thin film transistor. Then the green sub-pixels of the other pixels in the same row sequentially repeat the electrical connections of the green sub-pixels of the first and second pixels with the first scan line 380 and the data lines 392, 394, respectively. The green sub-pixel of the third pixel neighboring the first pixel and in the same column therewith is electrically connected with the first scan line 380 immediately therebelow and the data line 392 adjacent thereto by a corresponding thin film transistor. Then the green sub-pixels of the other pixels in the same column sequentially repeat the electrical connections of the green sub-pixels of the first and third pixels with the first scan lines 380 and the data line 392.

The blue sub-pixel 376 of the first pixel 371 is electrically connected with the second scan line 382 immediately therebelow and the data lines 394 adjacent thereto by a thin film transistor 377. The thin film transistor 377 has a source electrode in electrical coupling with the data line 394, a gate electrode in electrical coupling with the second scan line 382 and a drain electrode in electrical coupling with a pixel electrode of the blue sub-pixel 376. The blue sub-pixel of the second pixel neighboring the first pixel and in the same row therewith is electrically connected with the second scan line 382 immediately therebelow and the data line 392 adjacent thereto by a corresponding thin film transistor. Then the blue sub-pixels of the other pixels in the same row sequentially repeat the electrical connections of the blue sub-pixels of the first and second pixels with the second scan line 382 and the data lines 394, 392, respectively. The blue sub-pixel of the third pixel neighboring the first pixel and in the same column therewith is electrically connected with the second scan line 382 immediately therebelow and the data line 394 adjacent thereto by a corresponding thin film transistor. Then the blue sub-pixels of the other pixels in the same column sequentially repeat the electrical connections of the blue sub-pixels of the first and third pixels with the second scan lines 382 and the data line 394.

The white sub-pixel 378 of the first pixel 371 is electrically connected with the second scan line 382 immediately therebelow and the data line 398 adjacent thereto by a thin film transistor 379. The thin film transistor 379 has a source electrode in electrical coupling with the data line 398, a gate electrode in electrical coupling with the second scan line 382 and a drain electrode in electrical coupling with a pixel electrode of the white sub-pixel 378. The white sub-pixel of the second pixel neighboring the first pixel and in the same row therewith is electrically connected with the second scan line 382 immediately therebelow and the data line 396 adjacent thereto by a corresponding thin film transistor. Then the white sub-pixels of the other pixels in the same row sequentially repeat the electrical connections of the white sub-pixels of the first and second pixels with the second scan line 382 and the data lines 398, 396, respectively. The white sub-pixel of the third pixel neighboring the first pixel and in the same column therewith is electrically connected with the second scan line 382 immediately therebelow and the data line 398 adjacent thereto by a corresponding thin film transistor. Then the white sub-pixels of the other pixels in the same column sequentially repeat the electrical connections of the white sub-pixels of the first and third pixels with the second scan lines 382 and the data line 398. Since in this embodiment, the sub-pixels are driven by column inversion, along each of the data lines 392, 394, 396, 398 the sub-pixels in electrical connection therewith have the same polarity.

Figure 6:
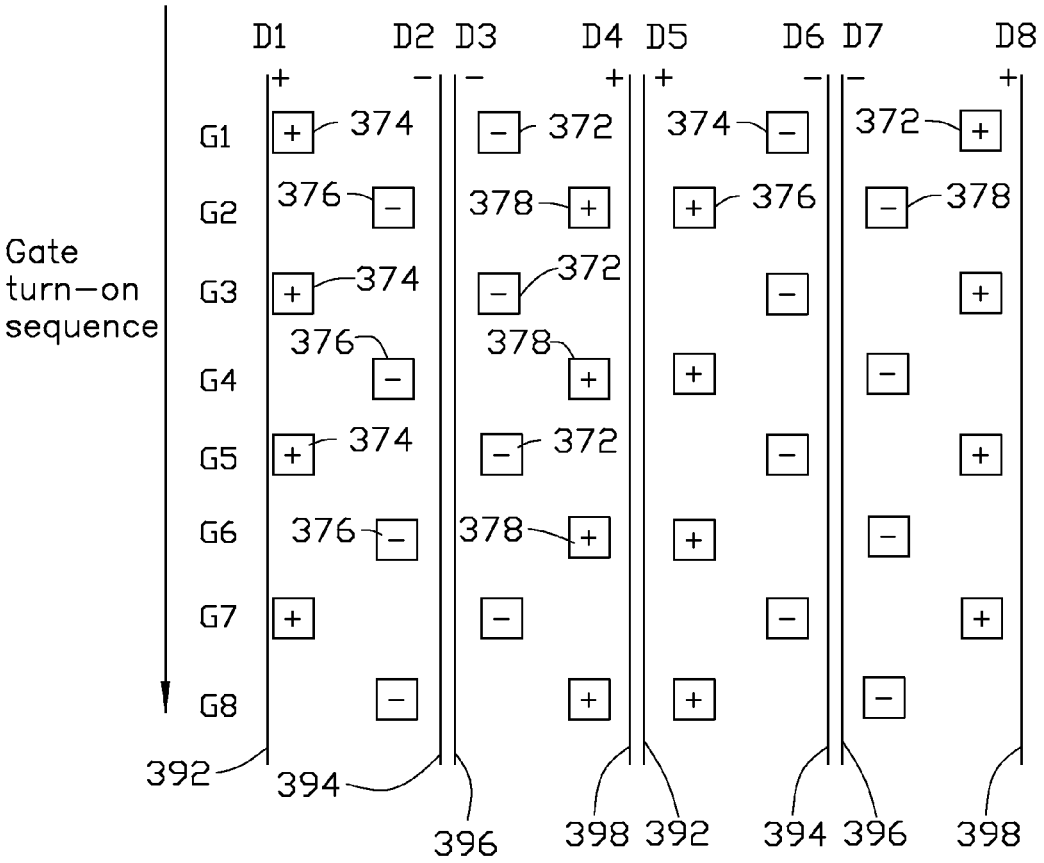
FIG. 6 is a diagram showing a control sequence of scan lines of the TFT array substrate of FIG. 5.

In operation, in the frame shown in FIG. 6, the data lines 392, 398 each are supplied with a positive voltage while the data lines 394, 396 each are supplied with a negative voltage, whereby the red (green, blue, white) sub-pixel 372 (374, 376, 378) and a neighboring red (green, blue, white) sub-pixel in the same row have opposite polarities. The first and second scan lines 380, 382 are successively turned on along a top to bottom direction, wherein each time two respective first and second scan lines 380, 382 are turned on. In other words, the gates G1, G2 of the thin film transistors in connection with the upmost first and second scan lines 380, 382 are firstly turned on; then the gates G3, G4 are turned on, and so on. Accordingly when the RGBW TFT LCD having the TFT substrate 30 is required to show a single color of one of the red, green, blue and white colors, the pixels 371 in two neighboring columns have opposite polarities, i.e., one being positive and the other being negative. By such arrangement, the coupling effects caused by capacitors (Cscs, not shown) of each two neighboring columns of the pixels 371 on the waveform of a common electrode (Com, not shown) can offset from each other to obviate the horizontal crosstalk, wherein the capacitor (Csc) is a capacitor interconnecting a corresponding data line and the common electrode (Com) for supplying a bias across a liquid crystal layer (not shown). The common electrode (Com) and the capacitors (Cscs) are well known by those skilled in the art; detailed descriptions thereof are omitted here.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in particular the matters of shape, size and arrangement of parts within the principles of the present disclosure, up to and including the full extent established by the broad general meaning of the terms used in the claims.

What is claimed is:

1. A thin film transistor (TFT) array substrate for a display, comprising:

a plurality of pairs of data lines;

a plurality of scan lines; each of the plurality of scan lines intersecting the plurality of pairs of data lines;

a plurality of pixels arranged in a plurality of pairs of rows and columns identified as a first row, a second row, a first column, and a second column, each of the plurality of pixels comprising a red sub-pixel, a green sub-pixel, a blue sub-pixel and a white sub-pixel, wherein the red and green sub-pixels are arranged in a plurality of the first rows, the blue and white sub-pixels are arranged in a plurality of the second rows alternating with the first rows, the red and white sub-pixels are arranged in a plurality of the first columns, and the green and blue sub-pixels are arranged in a plurality of the second columns alternating with the first columns;

wherein the red and green sub-pixels of a pixel are electrically connected to a common scan line, and the blue and white sub-pixels of the pixel are electrically connected to another common scan line;

wherein the scan lines electrically connected to the plurality of pixels are successively activated in a vertical direction, and the sub-pixels are electrically driven by a column inversion whereby the sub-pixels in electrical connection with a same data line have a same polarity as each other; and wherein, when the display is operated to output a screen having one color of red, green, blue and white colors, two adjacent sub-pixels in a same row of the sub-pixels which are for generating the one color have opposite polarities and two adjacent sub-pixels in a same column of the sub-pixels which are for generating the one color have the same polarity;

wherein in a frame, the data lines are applied with voltages having polarities of +, −, −, +, then −, +, +, −, and then a repeated pattern of the aforesaid polarities along a lateral, column direction of the TFT array substrate.

2. The TFT array substrate of claim 1, wherein each of the plurality of pairs of data lines is between every two adjacent columns of the sub-pixels; the sub-pixels in each column of the sub-pixels are electrically coupled to two data lines; the sub-pixels generating same color in a same column of the sub-pixels are electrically coupled to a same data line; the sub-pixels generating different colors in a same column of the sub-pixels are electrically coupled to different data lines.

3. A thin film transistor (TFT) array substrate for a display, comprising:

a plurality of pairs of data lines;

a plurality of scan lines; each of the plurality of scan lines intersecting the plurality of pairs of data lines;

a plurality of pixels arranged in a plurality of pairs of rows and columns identified as a first row, a second row, a first column, and a second column, each of the plurality of pixels comprising a red sub-pixel, a green sub-pixel, a blue sub-pixel and a white sub-pixel, wherein the red and green sub-pixels are arranged in a plurality of the first rows, the blue and white sub-pixels are arranged in a plurality of the second rows alternating with the first rows, the red and white sub-pixels are arranged in a plurality of the first columns, and the green and blue sub-pixels are arranged in a plurality of the second columns alternating with the first columns;

wherein the sub-pixels in each row of the sub-pixels are electrically coupled to a same scan line; the sub-pixels in any two different rows of the sub-pixels are electrically coupled to two different scan lines;

wherein the scan lines electrically connected to the plurality of pixels are successively activated in a vertical direction, and the sub-pixels are electrically driven by a column inversion whereby the sub-pixels in electrical connection with a same data line have a same polarity as each other; and wherein, when the display is operated to output a screen having one color of red, green, blue and white colors, two adjacent sub-pixels in a same row of the sub-pixels which are for generating the one color have opposite polarities and two adjacent sub-pixels in a same column of the sub-pixels which are for generating the one color have the same polarity;

wherein in a frame, the data lines are applied with voltages having polarities of +, −, −, +, and then a repeated pattern of the aforesaid polarities along a lateral, column direction of the TFT array substrate.

4. The TFT array substrate of claim 3, wherein each of the plurality of pairs of data lines is between every two adjacent columns of the sub-pixels; the sub-pixels in each column of the sub-pixels are electrically coupled to two data lines; the sub-pixels generating same color in a same column of the sub-pixels are electrically coupled to a same data line; the sub-pixels generating different colors in a same column of the sub-pixels are electrically coupled to different data lines.

* * * * *